US010925373B2

(12) United States Patent
Lee et al.

(10) Patent No.: US 10,925,373 B2
(45) Date of Patent: Feb. 23, 2021

(54) REFILL CASE FOR COSMETIC COMPACT

(71) Applicant: Newfrontech Co., LTD., Gunpo-si (KE)

(72) Inventors: Yong-jun Lee, Seongnam-si (KR); Jin-gee Kim, Suwon-si (KR)

(73) Assignee: NEWFRONTECH CO., LTD., Gyeonggido (KR)

( * ) Notice: Subject to any disclaimer, the term of this patent is extended or adjusted under 35 U.S.C. 154(b) by 314 days.

(21) Appl. No.: 16/123,563

(22) Filed: Sep. 6, 2018

(65) Prior Publication Data

US 2019/0090610 A1 Mar. 28, 2019

(30) Foreign Application Priority Data

Sep. 23, 2017 (KR) ..... 10-2017-0123056

(51) Int. Cl.
*A45D 33/00* (2006.01)
*A45D 34/00* (2006.01)
(Continued)

(52) U.S. Cl.
CPC ..... *A45D 33/006* (2013.01); *A45D 33/24* (2013.01); *A45D 34/00* (2013.01); *B65D 25/10* (2013.01);
(Continued)

(58) Field of Classification Search
CPC ..... A45D 33/00; A45D 33/025; A45D 33/02; A45D 33/003; A45D 33/006;
(Continued)

(56) References Cited

U.S. PATENT DOCUMENTS

2003/0140936 A1* 7/2003 Yuhara ..... A45D 33/003 132/307
2006/0151355 A1* 7/2006 Oh ..... A45D 33/008 206/581
(Continued)

FOREIGN PATENT DOCUMENTS

CN 202160969 U 3/2012
JP 2003090661 A 3/2003
(Continued)

*Primary Examiner* — Rachel R Steitz
*Assistant Examiner* — Karim Asqiriba
(74) *Attorney, Agent, or Firm* — Schmeiser, Olsen & Watts LLP

(57) ABSTRACT

Disclosed is a refill case detachably accommodated in a cosmetic compact, the refill case including: a main body being configured such that an upper portion thereof is open, and including an inner wall providing an accommodation space in the main body, and an outer wall provided at an outer side of the main body with a predetermined gap between the inner wall and the outer wall; and a mesh fabric cover including a cylindrical vertical extension portion tightly inserted in the gap, a rim portion extending from an upper end of the vertical extension portion in an inward direction, and a mesh fabric configured such that upper and lower surfaces thereof are interposed between the upper end of the vertical extension portion and an outer edge the rim portion along an edge thereof to be integrally provided, thereby covering an upper portion of the accommodation space.

9 Claims, 10 Drawing Sheets

(51) Int. Cl.

| | |
|---|---|
| ***A45D 33/24*** | (2006.01) |
| ***B65D 25/10*** | (2006.01) |
| ***B65D 43/16*** | (2006.01) |
| *A45D 33/06* | (2006.01) |

(52) U.S. Cl.

CPC ..... *B65D 43/16* (2013.01); *A45D 33/06* (2013.01); *A45D 2033/001* (2013.01); *A45D 2200/051* (2013.01)

(58) Field of Classification Search

CPC ..... A45D 33/005; A45D 33/06; A45D 33/16; A45D 33/24; A45D 34/00; A45D 40/22; A45D 2200/05; A45D 2200/051; A45D 2200/054; A45D 2200/1036; A45D 2033/001; A45D 37/00; B65D 25/10; B65D 25/107; B65D 43/02; B65D 43/16; B65D 2251/0018; B65D 2251/0028; B65D 2251/0084; B65D 2251/009; B65D 2543/00435

USPC ..... 206/235, 581; 220/4.22, 4.23, 370, 372, 220/324, 833, 810

See application file for complete search history.

(56) References Cited

U.S. PATENT DOCUMENTS

| | | | | |
|---|---|---|---|---|
| 2007/0029226 | A1* | 2/2007 | Yuhara | A45D 33/006 206/581 |
| 2015/0320174 | A1* | 11/2015 | Kim | A45D 40/22 132/295 |
| 2016/0235184 | A1* | 8/2016 | Lee | B65D 43/02 |
| 2017/0099930 | A1* | 4/2017 | Kim | A45D 33/24 |
| 2018/0049534 | A1* | 2/2018 | Kim | A45D 33/025 |
| 2018/0078018 | A1* | 3/2018 | Lee | B65D 83/00 |
| 2018/0207066 | A1* | 7/2018 | Lechanoine | A45D 34/04 |

FOREIGN PATENT DOCUMENTS

| | | |
|---|---|---|
| JP | 1020150128901 | 11/2015 |
| KR | 1020120116207 A | 10/2012 |

* cited by examiner

REFILL CASE FOR COSMETIC COMPACT

CROSS REFERENCE TO RELATED APPLICATION

The present application claims priority to Korean Patent Application No. 10-2017-0123056, filed Sep. 23, 2017, the entire contents of which is incorporated herein for all purposes by this reference.

BACKGROUND OF THE INVENTION

Field of the Invention

The present invention relates generally to a refill case detachably accommodated in a cosmetic compact. More particularly, the present invention relates to a refill case for a cosmetic compact, in which an accommodation structure for cosmetics is improved.

Description of the Related Art

As in the documents of Korean Patent No. 10-1466854 (registered Nov. 24, 2014), and Korean Patent Application Publication No. 10-2015-0010190 (published Jan. 28, 2015), a conventional cosmetic compact including a refill case is configured such that a porous pad, such as sponge or foamed urethane foam, is accommodated in the refill case, and contents, i.e. a liquid cosmetic, are impregnated into the pad.

However, since the liquid cosmetic accommodated in the conventional refill case is only a quantity impregnated into the pad, only a small amount of cosmetics can be accommodated relative to the inner space of the refill case. Even if the cosmetic is impregnated in the pad, is not completely consumed and a considerable amount of cosmetic impregnated in the pad is inevitably discarded. Further, the process of injecting a liquid cosmetic into the pad is performed during the repetitive compression and expansion of the pad, so that it takes a long time to impregnate the cosmetics and the productivity is lowered.

To solve the above problems, the inventor of the present invention has proposed inventions disclosed in the documents of Korean Patent No. 10-1541396 (registered Jul. 28, 2015) and Korean Patent No. 10-1556904 (registered Sep. 24, 2015), respectively.

The present invention is an improvement of the patented invention, and has been proposed to provide a structure in which the sealability to liquid cosmetics directly stored in a refill case without a pad is improved.

The foregoing is intended merely to aid in the understanding of the background of the present invention, and is not intended to mean that the present invention falls within the purview of the related art that is already known to those skilled in the art.

SUMMARY OF THE INVENTION

Accordingly, the present invention has been made keeping in mind the above problems occurring in the related art, and the present invention is intended to propose a refill case for a cosmetic compact, in which the refill case has an improved sealing structure to prevent leakage of a liquid cosmetic when the liquid cosmetic is directly accommodated in the refill case without being impregnated in a pad.

In order to achieve the above object, there is provided a refill case for a cosmetic compact, in which the refill case is detachably accommodated in a lower case of a cosmetic compact including an upper case and the lower case hinged to the upper case, the refill case including: a main body being configured such that an upper portion thereof is open, and including an inner wall providing an accommodation space in the main body, and an outer wall provided at an outer side of the main body with a predetermined gap between the inner wall and the outer wall; and a mesh fabric cover including a cylindrical vertical extension portion inserted in and brought into close contact with the gap between the inner wall and the outer wall, a rim portion extending from an upper end of the vertical extension portion by a predetermined width in an inward direction, and a mesh fabric configured such that upper and lower surfaces thereof are interposed between the upper end of the vertical extension portion and an outer edge the rim portion along an edge thereof to be integrally provided, thereby covering an upper portion of the accommodation space.

Herein, the refill case for a cosmetic compact may further include: a sponge having a predetermined vertical thickness accommodated such that an outer side surface thereof is brought into contact with an inner side surface of the vertical extension portion along an edge thereof, so as to cover the accommodation space from under the mesh fabric; and an auxiliary mesh fabric cover including an auxiliary rim portion accommodated such that an outer side surface thereof is brought into contact with the inner side surface of the vertical extension portion along an edge thereof, and an auxiliary mesh fabric integrally provided in the auxiliary rim portion along an edge thereof to cover the accommodation space from under the sponge, wherein both the sponge and the auxiliary mesh fabric cover are interposed between an upper end of the inner wall of the main body and a lower surface of the rim portion, such that the edge of the sponge and an outer edge of the auxiliary rim portion of the auxiliary mesh fabric cover are locked by being pressed by the upper end of the inner wall of the main body and the lower surface of the rim portion, by the cylindrical vertical extension portion inserted in and brought into close contact with the gap between the inner wall and the outer wall.

Here, both the sponge and the auxiliary mesh fabric may cover the accommodation space while being spaced apart from each other by a predetermined vertical gap due to the vertical thickness of the auxiliary rim portion.

The refill case for a cosmetic compact may further include: a second sponge having a predetermined vertical thickness accommodated such that a side surface thereof is brought into contact with the inner side surface of the vertical extension portion along an edge thereof, so as to cover the accommodation space from under the auxiliary mesh fabric; and a second auxiliary mesh fabric cover including a second auxiliary rim portion accommodated such that a side surface thereof is brought into contact with the inner side surface of the vertical extension portion along an edge thereof, and a second auxiliary mesh fabric integrally provided in the second auxiliary rim portion along an edge thereof to cover the accommodation space from under the second sponge, wherein both the second sponge and the second auxiliary mesh fabric cover are interposed between the upper end of the inner wall of the main body and the lower surface of the rim portion under the sponge and the auxiliary mesh fabric cover, such that the edge of the second sponge and an outer edge of the second auxiliary rim portion of the second auxiliary mesh fabric cover are locked by being pressed along with the edge of the sponge and the outer edge of the auxiliary rim portion of the auxiliary mesh fabric cover by the upper end of the inner wall of the main body and the lower surface of the rim portion, by the cylindrical vertical extension portion inserted in and brought into close contact with the gap between the inner wall and the outer wall.

Here, both the sponge and the auxiliary mesh fabric may cover the accommodation space while being spaced apart from each other by a predetermined vertical gap by the auxiliary rim portion, and both the second sponge and the second auxiliary mesh fabric may cover the accommodation space while being spaced apart from each other by a predetermined vertical gap due to the vertical thickness of the second auxiliary rim portion.

Meanwhile, between the gap between the inner wall and the outer wall and the vertical extension portion of the mesh fabric cover, at least one protruding portion and groove portion corresponding to each other in a radial direction may be provided such that the protruding portion and the groove portion are engaged with each other when the vertical extension portion is engaged with the gap between the inner wall and the outer wall.

Further, the gap between the inner wall and the outer wall may be provided with a plurality of groove portions recessed in a radial direction and spaced apart from each other by a predetermined vertical gap, and the vertical extension portion of the mesh fabric cover may be provided with a plurality of protruding portions spaced apart from each other by a predetermined vertical gap to correspond to the groove portions, such that the plurality of groove portions and protruding portions are engaged with each other when the vertical extension portion is engaged with the gap between the inner wall and the outer wall, wherein of the plurality of protruding portions, an uppermost protruding portion supports the outer edge of the auxiliary rim portion of the auxiliary mesh fabric cover, such that the sponge and the auxiliary mesh fabric cover accommodated in the vertical extension portion are prevented from being separated from the vertical extension portion.

Further, the gap between the inner wall and the outer wall may be provided with a plurality of groove portions recessed in a radial direction and spaced apart from each other by a predetermined vertical gap, and the vertical extension portion of the mesh fabric cover may be provided with a plurality of protruding portions spaced apart from each other by a predetermined vertical gap to correspond to the groove portions, such that the plurality of groove portions and protruding portions are engaged with each other when the vertical extension portion is engaged with the gap between the inner wall and the outer wall, wherein of the plurality of protruding portions, an uppermost protruding portion supports the outer edge of the second auxiliary rim portion of the second auxiliary mesh fabric cover, such that the sponge, the auxiliary mesh fabric cover, the second sponge, and the second auxiliary mesh fabric cover accommodated in the vertical extension portion are prevented from being separated from the vertical extension portion.

Meanwhile, the rim portion of the mesh fabric cover may be provided with an extension protruding portion protruding in the radial direction outside the vertical extension portion, and an inner side surface of an upper end portion of the outer wall may be provided with an extension groove portion recessed in the radial direction to correspond to the extension protruding portion, such that when the vertical extension portion is inserted in the gap between the inner wall and the outer wall, the extension protruding portion is inserted in the extension groove portion.

The refill case for a cosmetic compact may further include a case cover rotatably coupled to the main body to cover and uncover the main body, wherein the outer wall of the main body is provided along an upper surface thereof with an accommodation groove, and the case cover is provided on a lower surface thereof with a sealing protrusion accommodated in the accommodation groove, wherein a silicone is applied to the accommodation groove, and an elastomer is integrally formed with the sealing protrusion, such that when the main body is covered with the case cover, the sealing protrusion is accommodated in the accommodation groove and the elastomer is brought into close contact with a surface of the silicone, whereby the accommodation space is sealed.

According to the refill case for a cosmetic compact of the present invention, it is advantageous in that the refill case has an improved sealing structure to prevent leakage of a liquid cosmetic when the liquid cosmetic is directly accommodated in the refill case without being impregnated in a pad.

It is further advantageous in that considering a liquid cosmetic with a low viscosity, a sponge, and an auxiliary mesh fabric cover are provided, or in addition thereto, a second sponge, and a second auxiliary mesh fabric cover are further provided to prevent leakage of the cosmetic. As a result, one product can be applied to liquid cosmetics with various viscosities.

BRIEF DESCRIPTION OF THE DRAWINGS

The above and other objects, features, and other advantages of the present invention will be more clearly understood from the following detailed description when taken in conjunction with the accompanying drawings, in which.

DETAILED DESCRIPTION OF THE INVENTION

Hereinbelow, an exemplary embodiment of the present invention will be described in more detail with reference to the accompanying drawings.

Figure 1:
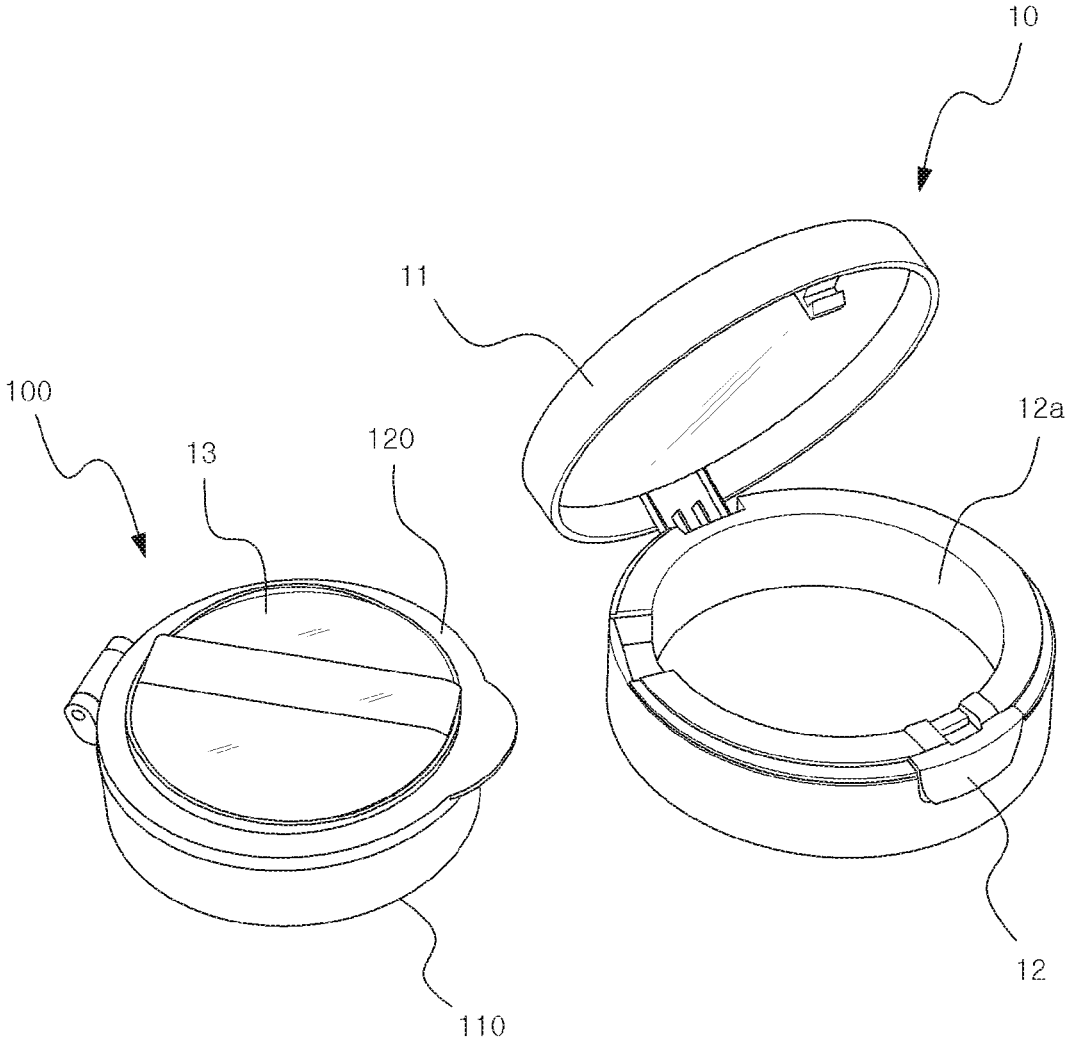
FIG. 1 is a separated perspective view showing a refill case for a cosmetic compact according to an embodiment of the present invention and a cosmetic compact including the same.

A refill case for a cosmetic compact 100 (hereinafter, referred to briefly as a 'refill case') according to an embodiment of the present invention is configured, as shown in FIG. 1, to be mounted in a lower case 12 of a cosmetic compact 10 with an upper case 11 hinged to the lower case, and when cosmetic stored therein is used up, the refill case is separated and discarded and replaced with a new refill case 100. The refill case 100 is detachably accommodated in an accommodation space 12*a* of the lower case 12.

Figure 2:
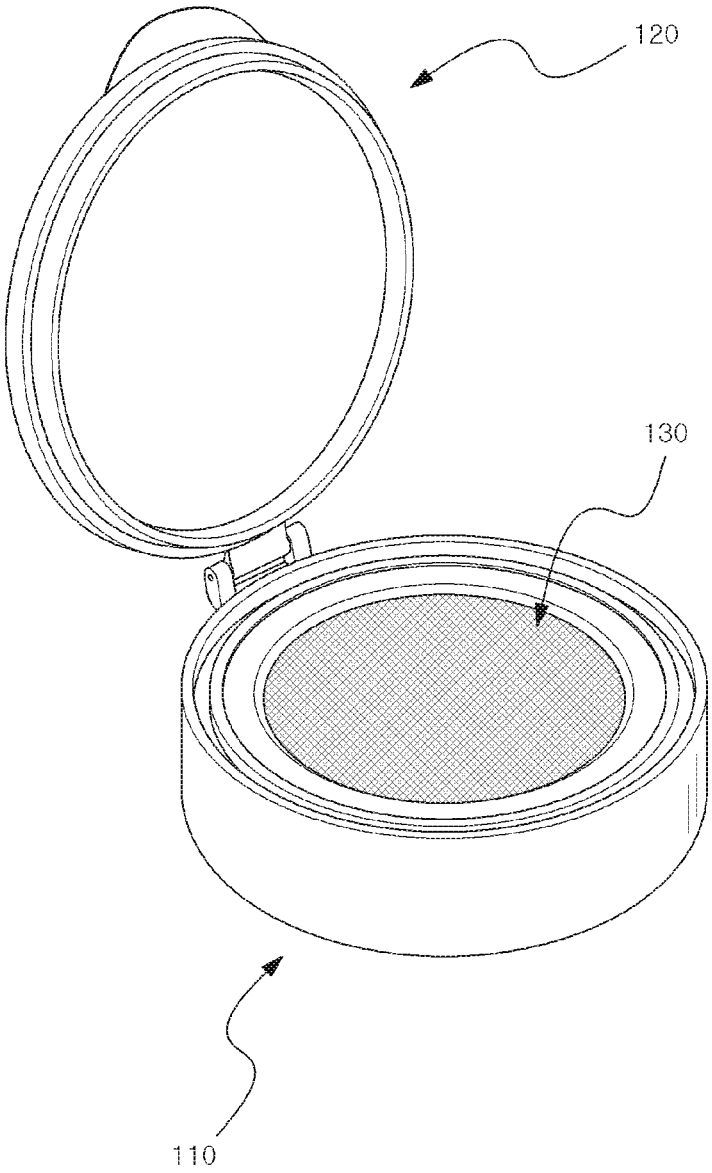
FIG. 2 is a perspective view showing an opened state of the refill case for a cosmetic compact of FIG. 1.
Figure 3:
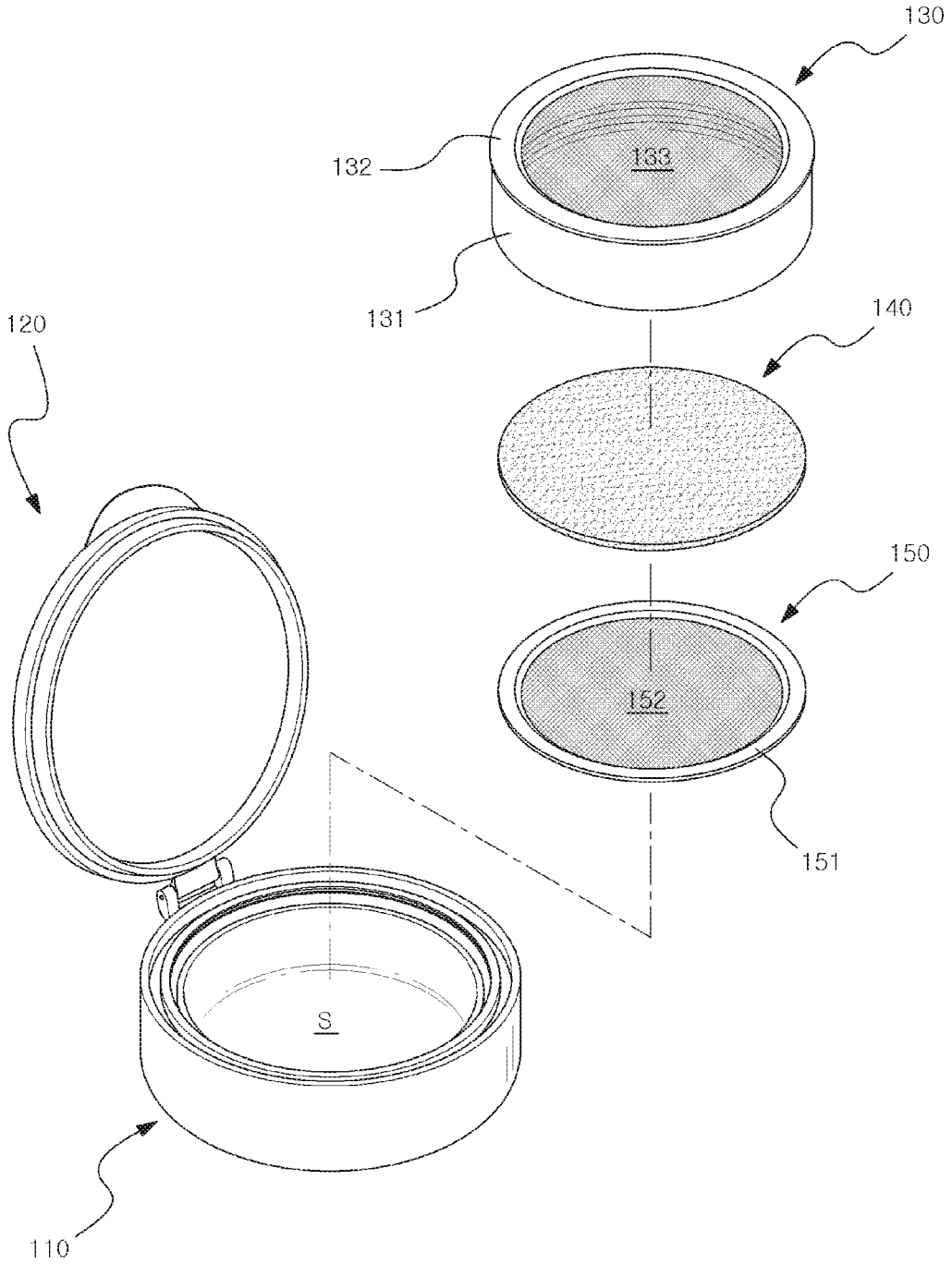
FIG. 3 is an exploded perspective view showing the refill case for a cosmetic compact of FIG. 2.

As shown in FIGS. 1 to 3, the refill case 100 includes: a main body 110 with an upper portion thereof being open; and a case cover 120 rotatably coupled to the main body 110 to seal or uncover the same.

An accommodation space S in the main body 110 accommodates a cosmetic, and as an inner cover for covering the accommodation space, a mesh fabric cover 130, a sponge 140, and an auxiliary mesh fabric cover 150 are separately provided. Thereby, the cosmetic in the accommodation space S can be supplied through the auxiliary mesh fabric cover 150, the sponge 140, and the mesh fabric cover 130. In other words, in the state of FIG. 2, when the mesh fabric cover 130 is pressed with a puff (reference numeral 13 in FIG. 1), the cosmetic in the accommodation space S seeps through the auxiliary mesh fabric cover 150, the sponge 140, and the mesh fabric cover 130 to wet the puff 13.

Figure 4:
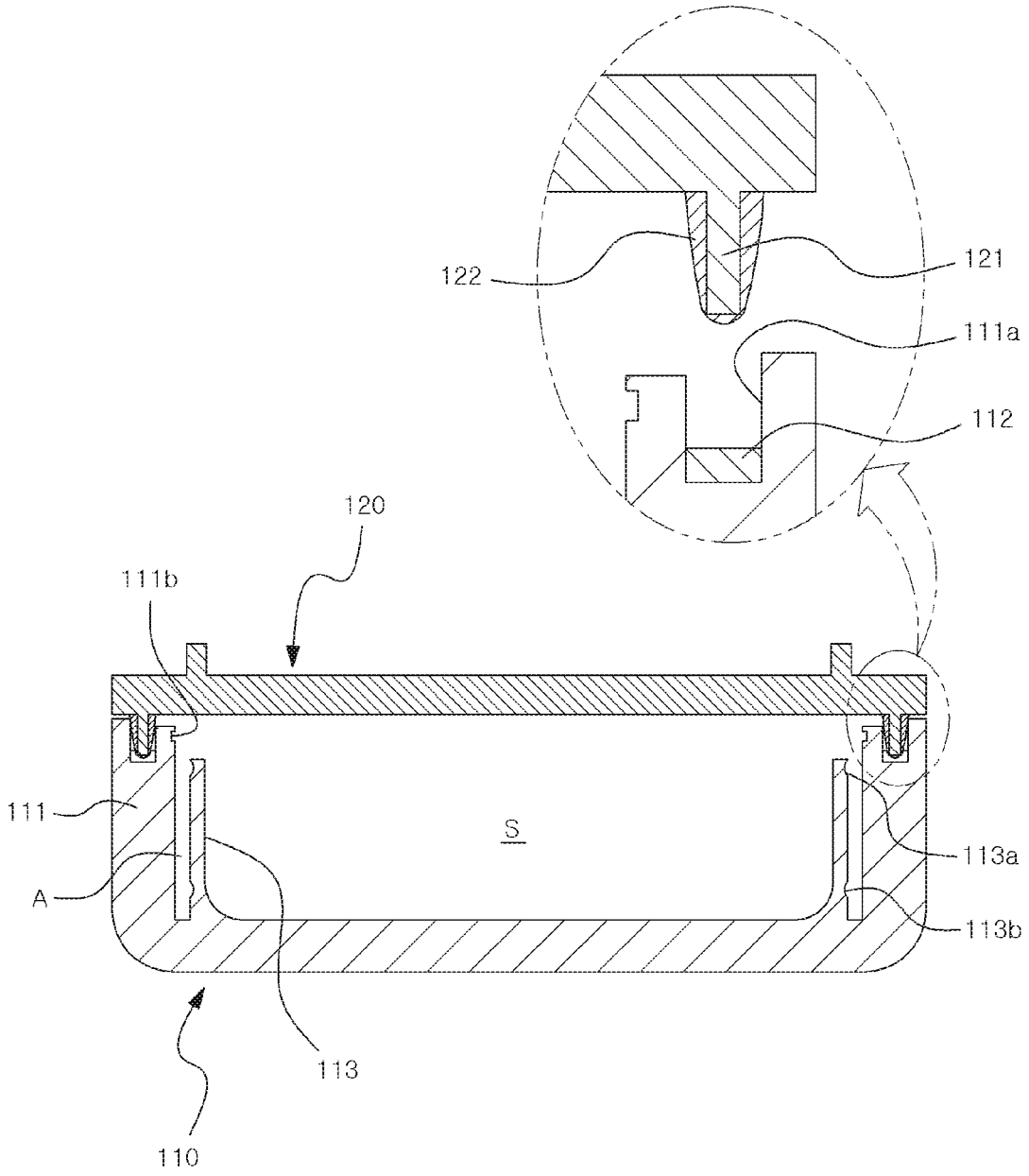
FIG. 4 is a sectional view showing a closed state between a main body and a case cover of the refill case for a cosmetic compact of FIG. 2.

To be specific to a sealing structure of the refill case 100, as shown in FIG. 4, an accommodation groove 111*a* is formed along an upper surface of an outer wall 111 of the main body 110, and a sealing protrusion 121 accommodated in the accommodation groove 111*a* is formed on a lower surface of the case cover 120 to correspond to the accommodation groove. Here, a silicone 112 is applied to the accommodation groove 111*a*, and an elastomer 122 is integrally formed with the sealing protrusion 121, such that when the case cover 120 is closed and the sealing protrusion 121 is accommodated in the accommodation groove 111*a*, the elastomer 122 is pressed against a surface of the silicone 112 and is brought into close contact therewith, thereby achieving a perfect sealing of the accommodation space S. Application of the elastomer 122 may be achieved by methods such as insert injection and the like.

Figure 5:
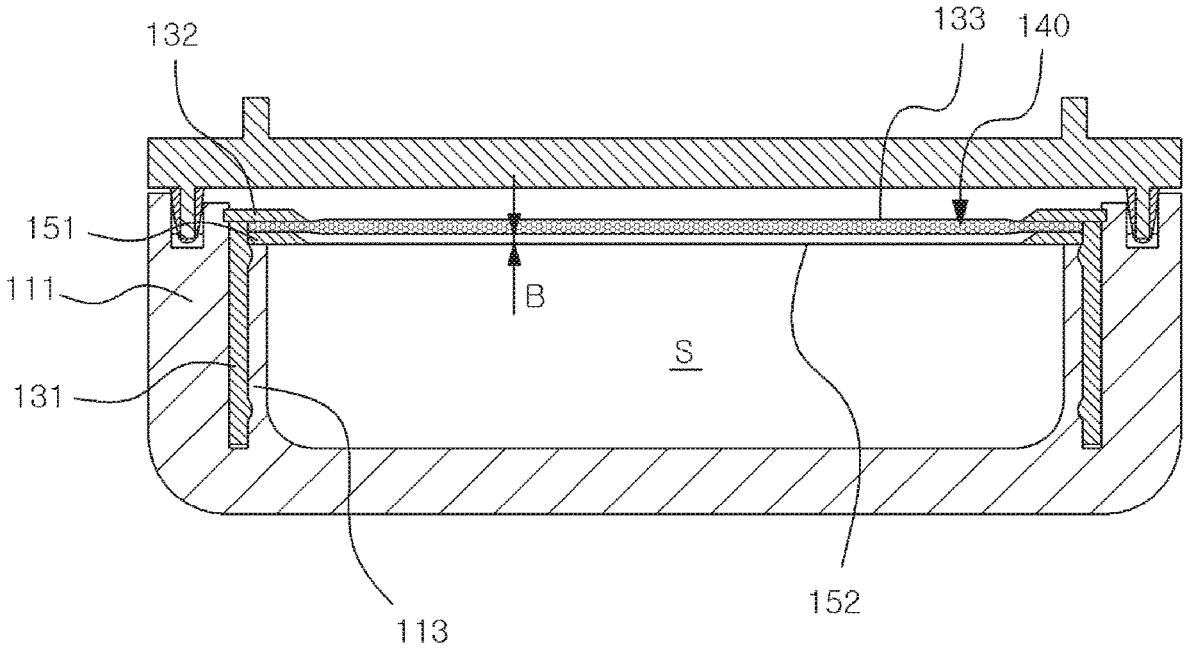
FIG. 5 is a sectional view showing a closed state of the refill case for a cosmetic compact of FIG. 2.

The main body 110 is provided with an inner wall 113 with a predetermined gap A between the inner wall and the outer wall 111. The accommodation space S is provided inside the inner wall 113. Further, as shown in FIGS. 5 and 6, a cylindrical vertical extension portion 131 of the mesh fabric cover 130 is engaged with the gap A between the inner wall 113 and the outer wall 111.

A rim portion 132 is formed by extending from an upper end of the vertical extension portion 131 by a predetermined width in an inward direction, and a mesh fabric 133 is interposed between an upper surface of the vertical extension portion 131 and a lower surface of the rim portion 132, such that upper and lower surfaces of the mesh fabric are integrally formed by being interposed between the upper end of the vertical extension portion 131 and an outer edge the rim portion 132 along an edge of the mesh fabric. Thereby, the mesh fabric 133 covers an upper portion of the accommodation space S.

Accordingly, a liquid cosmetic accommodated in accommodation space S is discharged outside only through the mesh fabric 133 because the vertical extension portion 131 is tightly engaged with the gap A between the inner wall 113 and the outer wall 111. Thus, it is possible to prevent leakage of cosmetics with a considerable viscosity by using a single mesh fabric cover 130.

Figure 6:
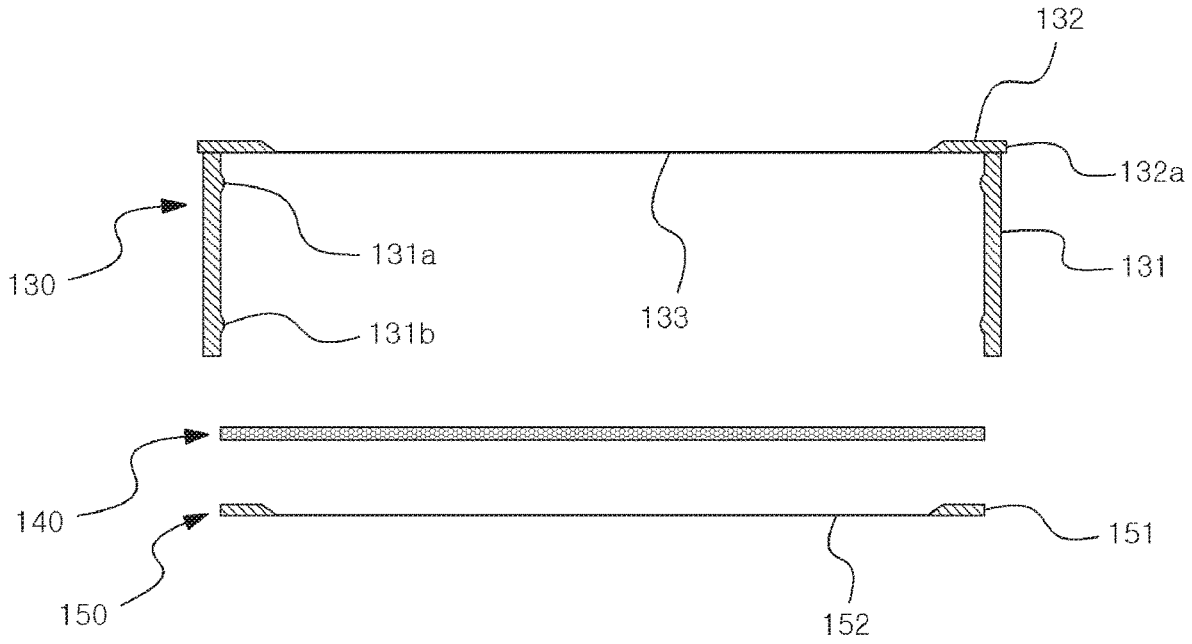
FIG. 6 is a sectional view showing a mesh fabric cover, a sponge, and an auxiliary mesh fabric of FIG. 3.

Meanwhile, considering liquid cosmetics with a low viscosity, as shown in FIGS. 3 and 6, under the mesh fabric cover 130, the sponge 140 and the auxiliary mesh fabric cover 150 may be further provided. The sponge 140 has a predetermined vertical thickness, is accommodated such that an outer side surface thereof is brought into contact with an inner side surface of the vertical extension portion 131 of the mesh fabric cover 130 along an edge thereof, and in this state, as shown in FIG. 5, covers the accommodation space S from under the mesh fabric 133.

The auxiliary mesh fabric cover 150 provided under the sponge 140 is accommodated such that an outer side surface of an auxiliary rim portion 151 formed along the auxiliary mesh fabric cover is brought into contact with the inner side surface of the vertical extension portion 131 of the mesh fabric cover 130, and an edge of an auxiliary mesh fabric 152 is integrally formed on the lower surface of the auxiliary rim portion 151. Thereby, the auxiliary mesh fabric 152 covers the accommodation space S from under the sponge 140.

In the state of FIG. 6 where the sponge 140 and the auxiliary mesh fabric cover 150 are accommodated in the mesh fabric cover 130 and arranged on top of each other, as shown in FIG. 5, when the vertical extension portion 131 is tightly engaged with the gap (A in FIG. 4) between the inner wall 113 and the outer wall 111, the edge of the sponge 140 and an outer edge of the auxiliary rim portion 151 of the auxiliary mesh fabric cover 150 are locked by being vertically pressed by the upper end of the inner wall 113 and the lower surface of the rim portion 132 of the mesh fabric cover 130.

Accordingly, even if a cosmetic accommodated in the accommodation space S has a low viscosity, it is possible to prevent leakage of the cosmetic by further providing the sponge 140 and the auxiliary mesh fabric cover 150 in addition to the mesh fabric cover 130.

Here, as shown in FIG. 5, the auxiliary mesh fabric 152 and the sponge 140 thereabove directly facing the accommodation space S are spaced apart from each other by a predetermined vertical gap B of the auxiliary rim portion 151, wherein in a space defined by the gap B, the cosmetic in the accommodation space S seeps and is contained, and when the mesh fabric 133 is pressed by a user with the puff (reference numeral 13 in FIG. 1), the cosmetic contained in the gap B serves as priming and thus is easily discharged outside. Accordingly, even in a multilayer structure constituted by the mesh fabric 133, the sponge 140, and the auxiliary mesh fabric 152, it is possible to use cosmetics without inconvenience.

Meanwhile, as shown in FIGS. 5 and 6, the rim portion 132 of mesh fabric cover 130 is configured such that an inner edge thereof is formed to be inclined downward in the inward direction, whereby when the puff (reference numeral 13 in FIG. 1) is pressed, it is possible to realize a soft touch feeling without being caught on a sharp edge.

Further, in FIG. 6, the vertical extension portion 131 of the mesh fabric cover 130 is provided on an inner surface thereof with protruding portions 131*a* and 131*b* protruding while being spaced apart from each other by a predetermined vertical gap, and as shown in FIG. 4, the inner wall 113 of the main body 110 is provided with groove portions 113*a* and 113*b* spaced apart from each other by a predetermined vertical gap in the radial direction to correspond to the protruding portions.

Accordingly, when the vertical extension portion 131 is engaged with the gap A between the inner wall 113 and the outer wall 111 of the main body 110, the protruding portions 131*a* and 131*b* are engaged with the groove portions 113*a* and 113*b* respectively, whereby it is possible to improve the coupling strength of the mesh fabric cover 130 to the main body 110.

Here, of the two protruding portions 131*a* and 131*b*, the upper protruding portion 131*a* supports the outer edge of the auxiliary rim portion 151 of the auxiliary mesh fabric cover 150 when the sponge 140 and the auxiliary mesh fabric cover 150 are inserted under the mesh fabric cover 130 as shown in FIG. 6, such that the sponge 140 and the auxiliary mesh fabric cover 150 accommodated in the vertical extension portion 131 are prevented from being separated from the vertical extension portion (see FIG. 5). Thereby, there is an advantage that the assembling process is simplified.

Further, referring to FIGS. 4 and 6, the rim portion 132 of the mesh fabric cover 130 is provided with an extension protruding portion 132*a* protruding in the radial direction outside the vertical extension portion 131, and the outer wall 111 of the main body 110 is provided with an extension groove portion 111*b* recessed in the radial direction to correspond to the extension protruding portion, such that when the vertical extension portion 131 is inserted in the gap A between the inner wall 113 and the outer wall 111, the extension protruding portion 132*a* is correspondingly engaged with the extension groove portion 111*b*. Thereby, a more rigid coupling of the mesh fabric cover 130 to the main body 110 can be achieved.

Figure 7:
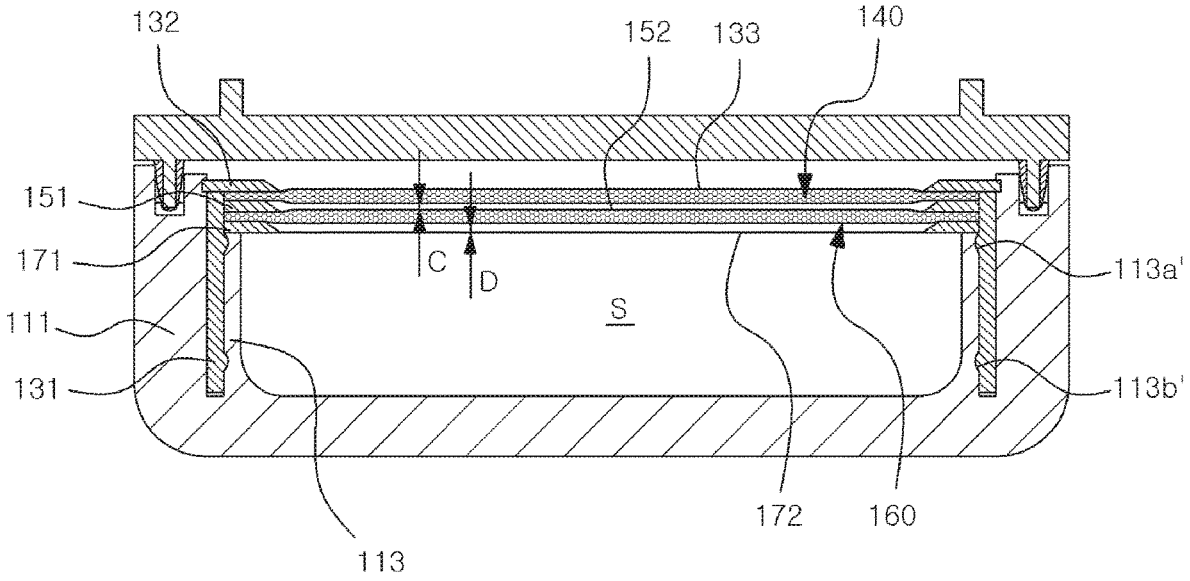
FIG. 7 is a sectional view showing a modification of the refill case for a cosmetic compact of FIG. 2 in the closed state.
Figure 8:
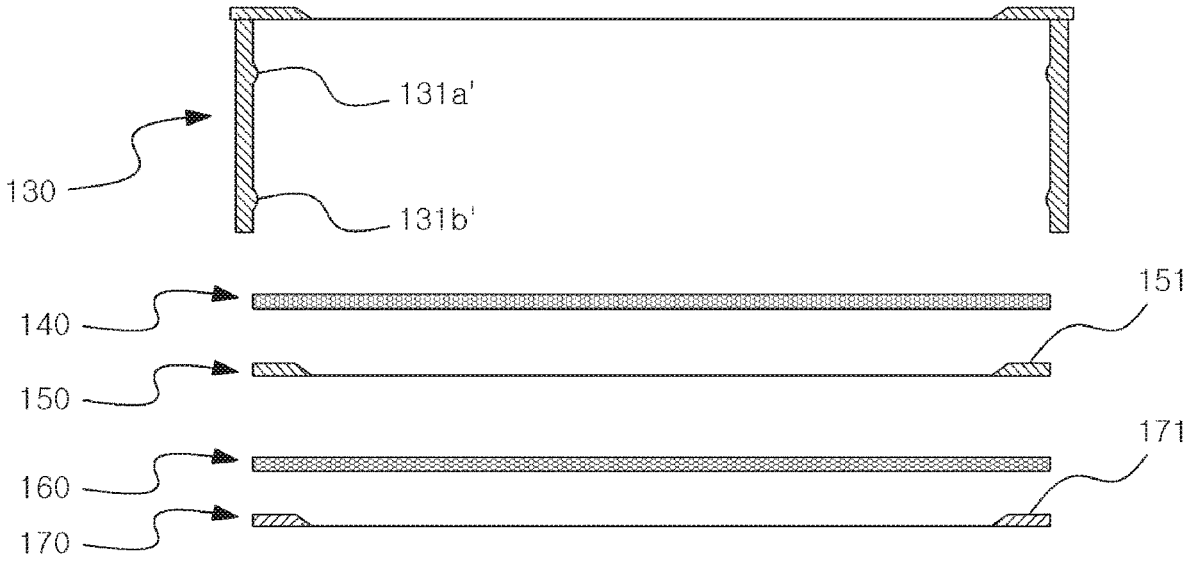
FIG. 8 is a separated sectional view showing the mesh fabric cover, the sponge, the auxiliary mesh fabric, a second sponge, and a second auxiliary mesh fabric of FIG. 7.

Meanwhile, considering cosmetics with a lower viscosity, as shown in FIGS. 7 and 8, under the mesh fabric cover 130, in addition to the sponge 140 and the auxiliary mesh fabric cover 150, a second sponge 160 and a second auxiliary mesh fabric cover 170 may be further provided. In the embodiment, the individual structures of the second sponge 160 and the second auxiliary mesh fabric cover 170 are the same as those of the sponge 140 and the auxiliary mesh fabric cover 150 described above.

Accordingly, even if the cosmetic accommodated in the accommodation space S has a considerably low viscosity, it is possible to solve the leakage problem of low viscosity cosmetics when the sponge 140, the auxiliary mesh fabric cover 150, the second sponge 160, and the second auxiliary mesh fabric cover 170 are further provided based on the mesh fabric cover 130.

Here, the edge of the second sponge 160 and an outer edge of the second auxiliary rim portion 171 of the second auxiliary mesh fabric cover 170 are locked by being pressed along with the edge of the sponge 150 and the outer edge of the auxiliary rim portion 151 of the auxiliary mesh fabric cover 150 by the upper end of the inner wall 113 of the main body and the lower surface of the rim portion 132, by the vertical extension portion 131 inserted in the gap between the inner wall 113 and the outer wall 111.

Also in this case, referring to FIG. 7, both the sponge 140 and the auxiliary mesh fabric 152 cover the accommodation space S while being spaced apart from each other by a predetermined vertical gap C by the auxiliary rim portion 151, and both the second sponge 160 and the second auxiliary mesh fabric 172 cover the accommodation space S while being spaced apart from each other by a predetermined vertical gap D due to the vertical thickness of the second auxiliary rim portion 171. Further, in spaces defined by the gaps C and D, the cosmetic in the accommodation space S seeps and is contained, and when the mesh fabric 133 is pressed by a user with the puff (reference numeral 13 in FIG. 1), the cosmetic contained in the gaps C and D serves as priming and thus is easily discharged outside. Accordingly, even in a multilayer structure constituted by the mesh fabric 133, the sponge 140, the auxiliary mesh fabric 152, the second sponge 160, and the second auxiliary mesh fabric 172, it is possible to use cosmetics without inconvenience.

Further, also in FIG. 8, the vertical extension portion 131 of the mesh fabric cover 130 is provided on an inner surface thereof with protruding portions 131*a*' and 131*b*' vertically spaced apart from each other, and as shown in FIG. 7, the inner wall 113 of the main body 110 is provided with groove portions 113*a*' and 113*b*' vertically spaced apart from each other in the radial direction to correspond to the protruding portions.

Accordingly, when the vertical extension portion 131 is engaged with the gap A between the inner wall 113 and the outer wall 111 of the main body 110, the protruding portions 131*a*' and 131*b*' are engaged with the groove portions 113*a*' and 113*b*' respectively, whereby it is possible to improve the coupling strength of the mesh fabric cover 130 to the main body 110.

Here, of the two protruding portions 131*a*' and 131*b*', the upper protruding portion 131*a*' supports the outer edge of the second auxiliary rim portion 171 of the second auxiliary mesh fabric cover 170 when the sponge 140, the auxiliary mesh fabric cover 150, the second sponge 160, and the second auxiliary mesh fabric cover 170 are inserted under the mesh fabric cover 130 as shown in FIG. 7, such that the sponge 140, the auxiliary mesh fabric cover 150, the second sponge 160, and the second auxiliary mesh fabric cover 170 accommodated in the vertical extension portion 131 are prevented from being separated from the vertical extension portion.

Figure 9:
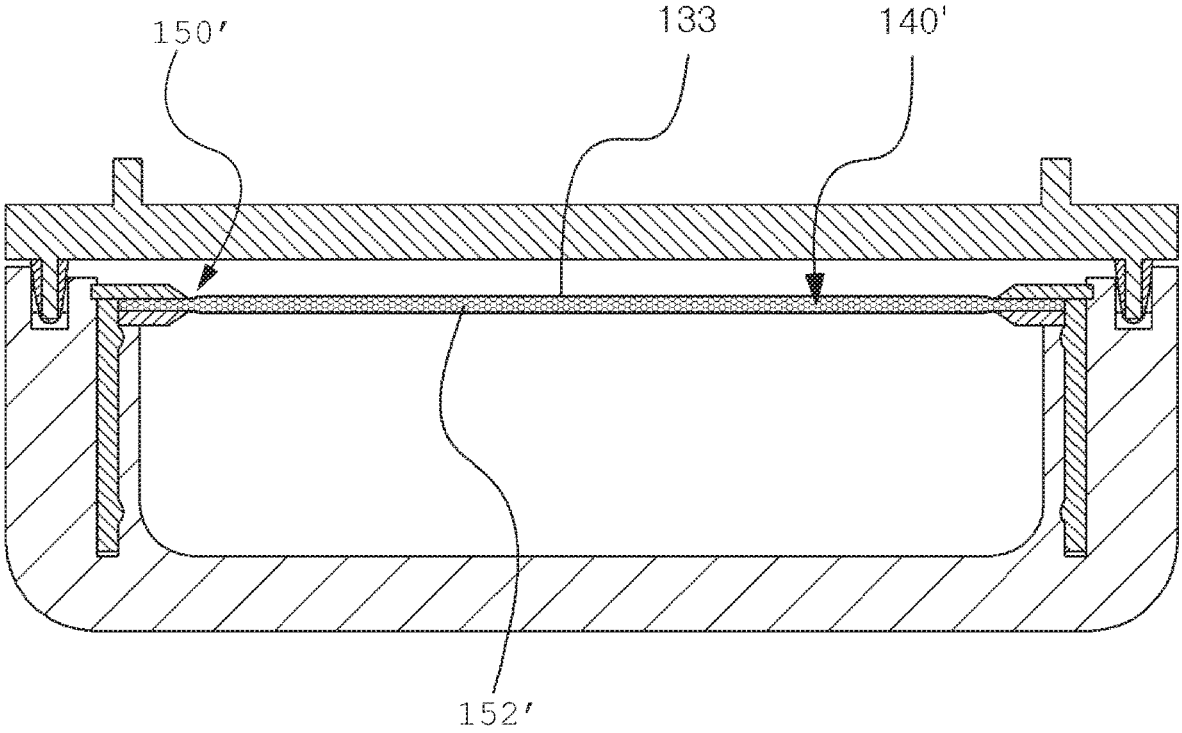
FIGS. 9 and 10 are sectional views respectively showing other modifications of the refill case for a cosmetic compact of FIG. 2 in the closed state.
Figure 10:
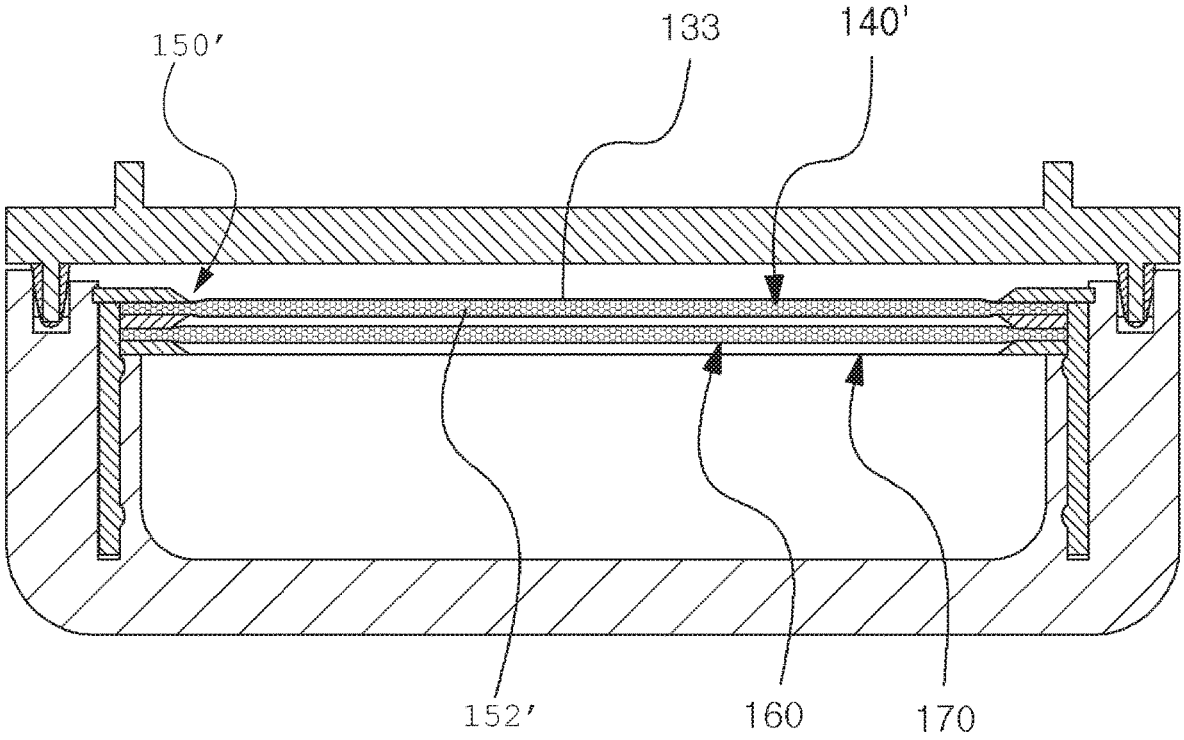

Meanwhile, in FIG. 6, when the auxiliary mesh fabric cover 150 turned upside down is coupled to the sponge 140 and the mesh fabric cover 130 and then is coupled to the main body 110, a coupling structure is shown as shown in FIG. 9. Herein, depending on the thickness and type of a sponge 140', there may be provided a structure in a convex shape brought in contact with and supported by both the upper mesh fabric 133 and the lower auxiliary mesh fabric 152'. Of course, in a similar manner, in the state of FIG. 9, under the auxiliary mesh fabric cover 150', the second sponge 160 and the second auxiliary mesh fabric cover 170 may be further provided to implement a five-layer structure of FIG. 10.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A refill case for a cosmetic compact, in which the refill case is detachably accommodated in a lower case of a cosmetic compact including an upper case and the lower case hinged to the upper case, the refill case comprising:

a main body being configured such that an upper portion thereof is open, and including an inner wall providing an accommodation space in the main body, and an outer wall provided at an outer side of the main body with a predetermined gap between the inner wall and the outer wall;

a mesh fabric cover including a cylindrical vertical extension portion inserted in and brought into close contact with the gap between the inner wall and the outer wall, a rim portion extending from an upper end of the vertical extension portion by a predetermined width in an inward direction, and a mesh fabric configured such that upper and lower surfaces thereof are interposed between the upper end of the vertical extension portion and an outer edge the rim portion along an edge thereof to be integrally provided, thereby covering an upper portion of the accommodation space;

a sponge having a predetermined vertical thickness accommodated such that an outer side surface thereof is brought into contact with an inner side surface of the vertical extension portion along an edge thereof, so as to cover the accommodation space from under the mesh fabric; and an auxiliary mesh fabric cover including an auxiliary rim portion accommodated such that an outer side surface thereof is brought into contact with the inner side surface of the vertical extension portion along an edge thereof, and an auxiliary mesh fabric integrally provided in the auxiliary rim portion along an edge thereof to cover the accommodation space from under the sponge, wherein both the sponge and the auxiliary mesh fabric cover are interposed between an upper end of the inner wall of the main body and a lower surface of the rim portion, such that the edge of the sponge and an outer edge of the auxiliary rim portion of the auxiliary mesh fabric cover are locked by being pressed by the upper end of the inner wall of the main body and the lower surface of the rim portion, by the cylindrical vertical extension portion inserted in and brought into close contact with the gap between the inner wall and the outer wall.

2. The refill case of claim 1, wherein both the sponge and the auxiliary mesh fabric cover the accommodation space while being spaced apart from each other by a predetermined vertical gap due to the vertical thickness of the auxiliary rim portion.

3. The refill case of claim 1, further comprising:

a second sponge having a predetermined vertical thickness accommodated such that a side surface thereof is brought into contact with the inner side surface of the vertical extension portion along an edge thereof, so as to cover the accommodation space from under the auxiliary mesh fabric; and a second auxiliary mesh fabric cover including a second auxiliary rim portion accommodated such that a side surface thereof is brought into contact with the inner side surface of the vertical extension portion along an edge thereof, and a second auxiliary mesh fabric integrally provided in the second auxiliary rim portion along an edge thereof to cover the accommodation space from under the second sponge, wherein both the second sponge and the second auxiliary mesh fabric cover are interposed between the upper end of the inner wall of the main body and the lower surface of the rim portion under the sponge and the auxiliary mesh fabric cover, such that the edge of the second sponge and an outer edge of the second auxiliary rim portion of the second auxiliary mesh fabric cover are locked by being pressed along with the edge of the sponge and the outer edge of the auxiliary rim portion of the auxiliary mesh fabric cover by the upper end of the inner wall of the main body and the lower surface of the rim portion, by the cylindrical vertical extension portion inserted in and brought into close contact with the gap between the inner wall and the outer wall.

4. The refill case of claim 3, wherein both the sponge and the auxiliary mesh fabric cover the accommodation space while being spaced apart from each other by a predetermined vertical gap by the auxiliary rim portion, and both the second sponge and the second auxiliary mesh fabric cover the accommodation space while being spaced apart from each other by a predetermined vertical gap due to the vertical thickness of the second auxiliary rim portion.

5. The refill case of claim 1, wherein between the gap between the inner wall and the outer wall and the vertical extension portion of the mesh fabric cover, at least one protruding portion and groove portion corresponding to each other in a radial direction are provided such that the protruding portion and the groove portion are engaged with each other when the vertical extension portion is engaged with the gap between the inner wall and the outer wall.

6. The refill case of claim 1, wherein the gap between the inner wall and the outer wall is provided with a plurality of groove portions recessed in a radial direction and spaced apart from each other by a predetermined vertical gap, and the vertical extension portion of the mesh fabric cover is provided with a plurality of protruding portions spaced apart from each other by a predetermined vertical gap to correspond to the groove portions, such that the plurality of groove portions and protruding portions are engaged with each other when the vertical extension portion is engaged with the gap between the inner wall and the outer wall, wherein of the plurality of protruding portions, an uppermost protruding portion supports the outer edge of the auxiliary rim portion of the auxiliary mesh fabric cover, such that the sponge and the auxiliary mesh fabric cover accommodated in the vertical extension portion are prevented from being separated from the vertical extension portion.

7. The refill case of claim 3, wherein the gap between the inner wall and the outer wall is provided with a plurality of groove portions recessed in a radial direction and spaced apart from each other by a predetermined vertical gap, and the vertical extension portion of the mesh fabric cover is provided with a plurality of protruding portions spaced apart from each other by a predetermined vertical gap to correspond to the groove portions, such that the plurality of groove portions and protruding portions are engaged with each other when the vertical extension portion is engaged with the gap between the inner wall and the outer wall, wherein of the plurality of protruding portions, an uppermost protruding portion supports the outer edge of the second auxiliary rim portion of the second auxiliary mesh fabric cover, such that the sponge, the auxiliary mesh fabric cover, the second sponge, and the second auxiliary mesh fabric cover accommodated in the vertical extension portion are prevented from being separated from the vertical extension portion.

8. The refill case of claim 1, wherein the rim portion of the mesh fabric cover is provided with an extension protruding portion protruding in the radial direction outside the vertical extension portion, and an inner side surface of an upper end portion of the outer wall is provided with an extension groove portion recessed in the radial direction to correspond to the extension protruding portion, such that when the vertical extension portion is inserted in the gap between the inner wall and the outer wall, the extension protruding portion is inserted in the extension groove portion.

9. The refill case of claim 1, further comprising:

a case cover rotatably coupled to the main body to cover and uncover the main body, wherein the outer wall of the main body is provided along an upper surface thereof with an accommodation groove, and the case cover is provided on a lower surface thereof with a sealing protrusion accommodated in the accommodation groove, wherein a silicone is applied to the accommodation groove, and an elastomer is integrally formed with the sealing protrusion, such that when the main body is covered with the case cover, the sealing protrusion is accommodated in the accommodation groove and the elastomer is brought into close contact with a surface of the silicone, whereby the accommodation space is sealed.

* * * * *